US011473251B2

(12) United States Patent
Bjorklund

(10) Patent No.: US 11,473,251 B2
(45) Date of Patent: Oct. 18, 2022

(54) CONTRAST ROAD MARKING APPARATUS

(71) Applicant: Fortson-Peek Company, Inc., Columbus, GA (US)

(72) Inventor: Mark S. Bjorklund, Midland, GA (US)

(73) Assignee: FORTSON-PEEK COMPANY, INC., Columbus, GA (US)

( * ) Notice: Subject to any disclaimer, the term of this patent is extended or adjusted under 35 U.S.C. 154(b) by 200 days.

(21) Appl. No.: 16/736,157

(22) Filed: Jan. 7, 2020

(65) Prior Publication Data

US 2021/0207330 A1 Jul. 8, 2021

(51) Int. Cl.

| | |
|---|---|
| ***E01C 23/24*** | (2006.01) |
| ***B05C 5/02*** | (2006.01) |
| ***E01F 9/518*** | (2016.01) |
| ***B05C 9/06*** | (2006.01) |
| ***E01C 23/16*** | (2006.01) |

(52) U.S. Cl.

CPC ..... *E01C 23/24* (2013.01); *B05C 5/0254* (2013.01); *B05C 9/06* (2013.01); *E01F 9/518* (2016.02); *E01C 23/166* (2013.01)

(58) Field of Classification Search

CPC ..... E01C 23/24; E01C 23/166; E01F 9/518; E01F 9/50; E01F 9/506; E01F 9/512

See application file for complete search history.

(56) References Cited

U.S. PATENT DOCUMENTS 3,788,879 A * 1/1974 Waysman ..... E01F 9/512 428/192
4,102,718 A * 7/1978 Eigenmann ..... E01C 23/185 156/291
5,203,923 A * 4/1993 Hartman ..... B05B 9/06 118/323
5,873,187 A * 2/1999 Kozak ..... E01F 9/524 40/612
5,928,761 A 7/1999 Hedblom et al.
6,051,297 A 4/2000 Maier et al.
6,679,650 B2 1/2004 Britt et al.
6,703,108 B1 3/2004 Bacon, Jr. et al.
6,841,223 B2 1/2005 Rice et al.
8,465,224 B2 6/2013 Price et al.
8,702,342 B2 * 4/2014 Price ..... E01C 23/22 404/75
10,364,537 B2 * 7/2019 Hong ..... B05B 12/04
(Continued)

FOREIGN PATENT DOCUMENTS

EP 1186711 A1 3/2002
WO 2019116180 A1 6/2019

OTHER PUBLICATIONS

MRL Equipment Company Inc., Flyer.

*Primary Examiner* — Abigail A Risic
(74) *Attorney, Agent, or Firm* — Thomas | Horstemeyer, LLP

(57) ABSTRACT

A contrast road marking apparatus can apply contrasting thermoplastic markings to a roadway in a single pass. The contrast road marking apparatus includes two or more ribbon guns configured to apply a first thermoplastic marking to a roadway location and a second thermoplastic marking, which comprises a color that contrasts with a color of the first thermoplastic marking, to another roadway location. The resulting contrast road marking has no visible or substantially negligible overlap or gap between the individual thermoplastic markings.

15 Claims, 7 Drawing Sheets

(56) References Cited

U.S. PATENT DOCUMENTS

| | | | | |
|---|---|---|---|---|
| 2003/0070579 | A1* | 4/2003 | Hong | C09J 7/22 106/31.04 |
| 2009/0202298 | A1* | 8/2009 | Bjorklund | E01C 23/166 404/77 |
| 2010/0279064 | A1* | 11/2010 | Pacey | C09J 7/20 428/137 |
| 2015/0056012 | A1* | 2/2015 | Greer | E01F 9/512 404/15 |
| 2015/0125669 | A1* | 5/2015 | Dietrichson | E01F 9/512 428/195.1 |
| 2016/0209559 | A1* | 7/2016 | McCarthy | E01F 9/512 |
| 2017/0204571 | A1* | 7/2017 | Shultz | E01C 23/222 |
| 2018/0335261 | A1* | 11/2018 | Shea | F28D 7/1607 |
| 2019/0177933 | A1* | 6/2019 | Driskell | E01F 9/512 |
| 2020/0011018 | A1* | 1/2020 | Clear | E01F 9/50 |
| 2020/0227904 | A1* | 7/2020 | Borer | C09J 7/29 |
| 2020/0283974 | A1* | 9/2020 | Ennet | B29C 66/73921 |
| 2020/0378076 | A1* | 12/2020 | Driskell | G02B 5/136 |

* cited by examiner

CONTRAST ROAD MARKING APPARATUS

BACKGROUND

Contrast road markings serve an important function for the safety of motorists, and it has even been reported that autonomous vehicles better recognize contrast road markings over non-contrast road markings. Previous methods of applying contrast road markings have included the use of preformed tape or applying a lighter colored marking directly above a wider contrast marking. However, applying markings directly above another results in markings with varying thicknesses between the two colors. In this scenario, depending on the exposure to traffic, the contrast may wear away prior to the secondary marking, or the top marking may be more susceptible to removal by snow plows, leaving only the other color visible. Also, contrast material that is beneath the lighter marking is unseen and therefore wasted material, adding to the cost of the product. In addition, if the markings are applied in separate passes or by a separate vehicle, alignment of the second marking might not be centered on the contrast marking leading to poor appearance. Simultaneously applying contrasting markings without allowing one to partially cool and become more viscous may cause the two markings to intermix, also resulting in an unacceptable marking. Preformed tape is rather expensive and slow to install, requiring road closures which further increase the installation cost.

SUMMARY

The present disclosure is directed to a contrast road marking apparatus that can apply contrasting thermoplastic markings to a roadway.

In various embodiments, an apparatus includes a first ribbon gun, a second ribbon gun, means for orienting the first ribbon gun, means for orienting the second ribbon gun, and means for moving the apparatus along the roadway. The first ribbon gun can be configured to apply a first thermoplastic marking while the second ribbon gun can be configured to apply a second thermoplastic marking. Additionally, the second thermoplastic marking comprises a color that contrasts with a color of the first thermoplastic marking. The apparatus also includes means for orienting the first ribbon gun so that the first thermoplastic marking is applied downwardly onto the roadway at a first roadway location and means for orienting the second ribbon so that the second thermoplastic marking is applied downwardly onto the roadway at a second roadway location, wherein the second roadway location is beside the first roadway location. A negligible gap or overlap between the first and second roadway locations may exist.

In other embodiments, an apparatus includes a plurality of wheels configured to move the apparatus along the roadway, a first ribbon gun, and a second ribbon gun. The first ribbon gun can be configured to apply a first thermoplastic marking downwardly at a first roadway location while the second ribbon gun can be configured to apply a second thermoplastic marking. In addition, the second ribbon gun can be aligned behind the first ribbon gun and configured to apply the second thermoplastic marking downwardly at second and third roadway locations, wherein the second and third roadway locations are beside the first roadway location, with the third roadway location also being on a side of the first roadway location opposite the second roadway location. A negligible gap or overlap between the first, second, and third roadway locations may exist.

Another embodiment, among others, is an apparatus for moving along a roadway and applying thermoplastic markings to the roadway. The apparatus has a first ribbon gun configured to apply a first thermoplastic marking at a first roadway surface area and a second ribbon gun configured to apply a second thermoplastic marking at a second roadway surface area. The second roadway surface area is adjacent to and substantially mutually exclusive of the first roadway surface area.

Yet another embodiment, among others, is an apparatus for moving along a roadway and applying thermoplastic markings to the roadway. The apparatus includes a first ribbon gun configured to apply a first thermoplastic marking at a first roadway surface area and a second ribbon gun configured to apply a second thermoplastic marking at a second roadway surface area. The second roadway surface area is different than and adjacent to the first roadway surface area. Moreover, each of the first and second thermoplastic surface areas are elongated in the travel direction with right and left edges. The left edge of the first thermoplastic surface area is substantially contiguous with the right edge of the second thermoplastic marking, or alternatively, the right edge of the first thermoplastic surface area being substantially contiguous with the left edge of the second thermoplastic marking.

Other embodiments, apparatus, methods, features, and advantages of the present invention will be or become apparent to one with skill in the art upon examination of the following drawings and detailed description.

Also described are methods for applying thermoplastic markings to a roadway, comprising: aligning a second ribbon gun behind a first ribbon gun at a predefined distance; moving the first and second ribbon guns along a roadway; applying, by the first ribbon gun, a first thermoplastic marking to a first roadway location; and applying, by the second ribbon gun, a second thermoplastic marking to a second roadway location, the second roadway location being beside the first roadway location. A negligible gap or overlap between the first and second roadway location may exist.

BRIEF DESCRIPTION OF THE DRAWINGS

Many aspects of the present disclosure can be better understood with reference to the following drawings. The components in the drawings are not necessarily drawn to scale, emphasis instead being placed upon clearly illustrating the principles of the disclosure. Moreover, in the drawings, like reference numerals designate corresponding parts throughout the several views.

DETAILED DESCRIPTION

Figure 1:
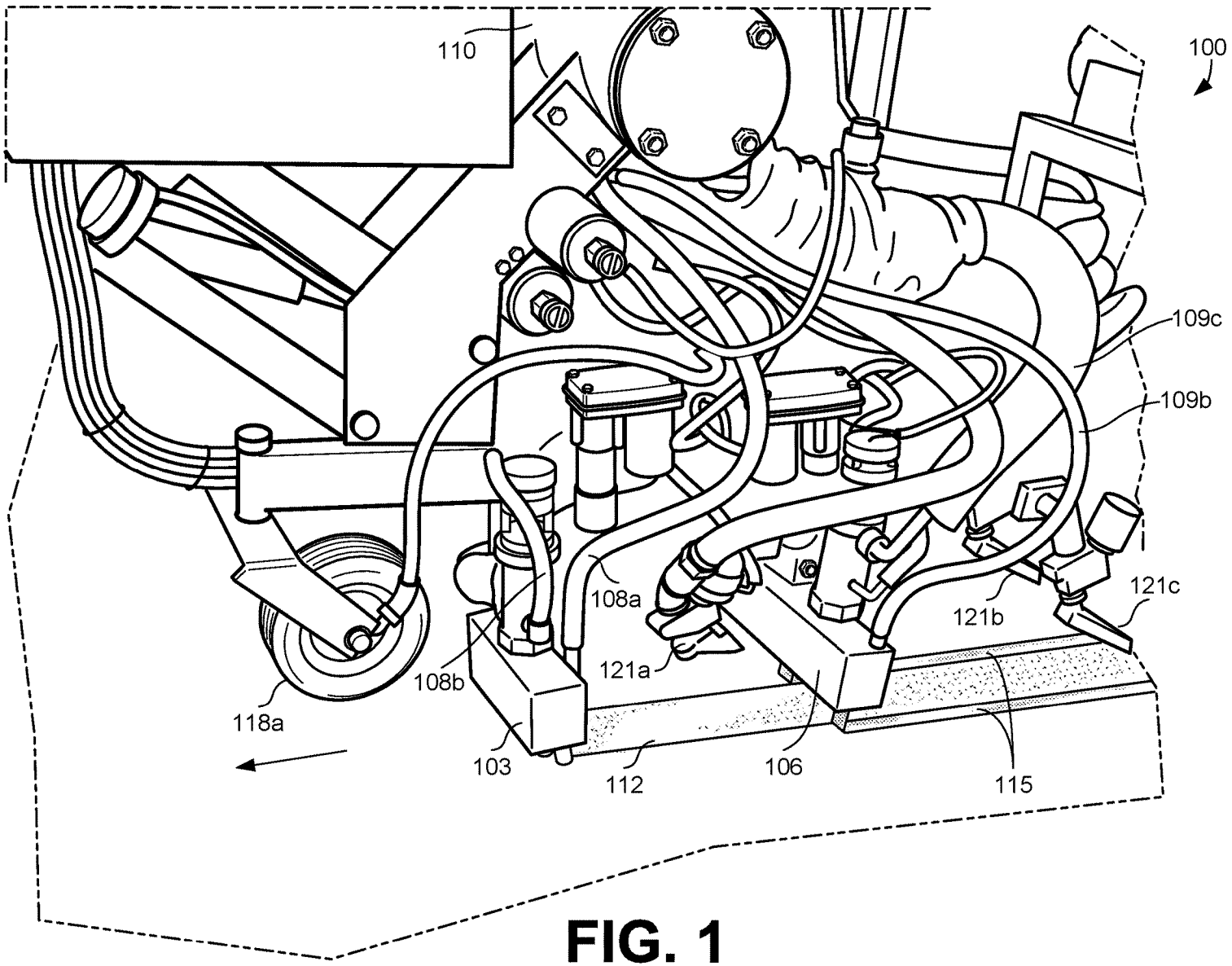
FIG. 1 is an illustration of a front-side perspective view of the contrast road marking apparatus positioned alongside a roadway according to various embodiments of the present disclosure.

The present disclosure relates to an apparatus and method for applying contrasting thermoplastic road markings to a roadway. As discussed above, contrasting thermoplastic road markings are useful when the road surface is of a similar color or reflectance to that of a typical road marking. Contrast markings generally incorporate a contrasting color, such as black, beside the lighter colored marking, such as white, to help the lighter colored marking stand out. The present disclosure is not limited to the colors described herein, and any different colors such as yellow, blue, green, or red may be substituted. Although particular embodiments are described, those embodiments are mere exemplary implementations of the apparatus. One skilled in the art will recognize other embodiments are possible. All such embodiments are intended to fall within the scope of this disclosure. While the disclosure will now be described in reference to the above drawings, there is no intent to limit it to the embodiments or embodiments disclosed herein. On the contrary, the intent is to cover all alternatives, modifications, and equivalents included within the spirit and scope of the disclosure.

According to various embodiments of the present disclosure, the contrast road marking apparatus allows contrasting thermoplastic markings to be applied in a same pass with substantially equal thickness (e.g., thickness 816, thicknesses 819*a*, 819*b*) to a road surface, thus creating at least one contrast zone between the markings. A plurality of ribbon guns are used to apply contrasting thermoplastic markings to a roadway in a same pass to prevent the two markings from intermixing. Benefits over previous methods of applying contrasting markings in separate passes or from separate vehicles include consistent alignment between the two markings leading to no visible or substantially negligible overlap or gap between them. Thus, the apparatus and method of the present disclosure can provide better visibility for instances such as when the intended pavement marking is of a similar color to that of a road surface. In some embodiments, the contrasting thermoplastic markings herein may also provide better visibility for instances when a particular message needs to be conveyed such as a bike lane or bus lane. Additionally, there is no wasted material or resources as in previous methods of where a lighter colored marking is applied directly above a wider contrast marking. Also, the lighter colored and contrast markings can be applied with similar thicknesses, which provide equal or substantially equal durability for both markings.

According to various embodiments, the contrast road marking apparatus can hot apply thermoplastic material to the road surface with ribbon guns, typically at temperatures between 390-425° F. A ribbon gun is a typical device used in applying thermoplastic road markings, and it generally comprises a slot perpendicular to the direction of application and a knife blade that pushes into the slot when material flow is not desired. When applying with a ribbon gun, typical thermoplastic will narrow from the width of the slot, pour onto the road with some degree of turbulence and then spread out back to approximately the width of the slot.

Hot applying gives the thermoplastic markings a fairly low viscosity when applied, which allows the thermoplastic material to penetrate into small crevices and craters of the road surface to create a strong bond. As the thermoplastic markings cool and solidify, the viscosity of the markings greatly increases. Below is a chart that shows independent lab viscosity test results of Crown Technology, LLC thermoplastic performed by FutureLabs, LLC in Madison, Miss.

| Temperature (F.) | 425 | 400 | 375 | 350 | 325 |
|---|---|---|---|---|---|
| Viscosity (Pa*s) | 3 | 3.4 | 5.4 | 7.6 | 12 |

In the following discussion, a general description of a contrast road marking apparatus and its components is provided, followed by a discussion of the operation of the same.

FIG. 1 illustrates a front-side perspective view of an example contrast road marking apparatus 100. The contrast road marking apparatus 100 includes a first ribbon gun 103, a second ribbon gun 106, oil jacketed feed lines 108*a*, 108*b*, 109*b*, and 109*c*, and glass sphere applicators 121*a*, 121*b*, and 121*c*. Both ribbon guns 103 and 106 are connected to at least one manifold 110, which houses the thermoplastic material to be applied, through the oil jacketed feed lines 108*a* and 108*b* for the first ribbon gun 103, and 109*b* and 109*c* for the second ribbon gun 106. The contrast road marking apparatus 100 also includes one or more wheels 118*a*, 118*b*, and 118*c*, which aid in moving the apparatus along a roadway. According to various embodiments, the apparatus 100 can be attached or affixed to an application vehicle, wherein the application vehicle can transport the apparatus 100 up and down a roadway.

The first ribbon gun 103 is configured to apply a first thermoplastic marking 112 to a first roadway location, and the second ribbon gun 106 is configured to apply a second thermoplastic marking 115 to second and third roadway locations. The first thermoplastic marking 112 can comprise lighter colors such as white, although any other color can be used such as yellow, blue, green, or red. As discussed in greater detail below, the second ribbon gun 106 is aligned behind the first ribbon gun 103 and applies a second thermoplastic marking 115 on the outer sides of the first thermoplastic marking 112 at second and third roadway locations without any visible or substantially negligible overlap or gap between the markings 115 and 112. The second thermoplastic marking 115 can comprise contrasting colors to that of the first thermoplastic marking 112 such as black to help the first thermoplastic marking 112 stand out, although other colors may be used. In some embodiments, the second ribbon gun 106 may apply the thermoplastic marking 115 only on one side of the thermoplastic marking 112 at only a second roadway location.

The second ribbon gun 106 is aligned as close as feasibly possible to the first ribbon gun 103 that still ensures the first thermoplastic marking 112 ample time to cool slightly and partially firm up before the second thermoplastic marking 115 is applied beside it. In some embodiments, the second ribbon gun 106 may be placed about 1 to 4 feet behind the first ribbon gun 103. In various embodiments, the first ribbon gun 103 is configured to start applying the first thermoplastic marking 112 first, while the second ribbon gun 106 is configured to start applying the second thermoplastic marking 115 after a delay ranging from about 1 to 4 feet. This delay is a time or distance required for the second ribbon gun 106 to reach a same or substantially similar starting application position as the first ribbon gun 103 so that both ribbon guns start and stop applying the thermoplastic markings 112 and 115 at substantially similar roadway locations. The delay may be enforced through the use of a delay timer. Additionally, this delay allows the markings 112 and 115 to be applied in a same pass or from the same application vehicle. The glass sphere applicators 121*a*, 121*b*, and 121*c* may be used to sprinkle glass spheres or skid resistant particles on either thermoplastic marking 112, 115 prior to complete solidification of the two markings.

Figure 2:
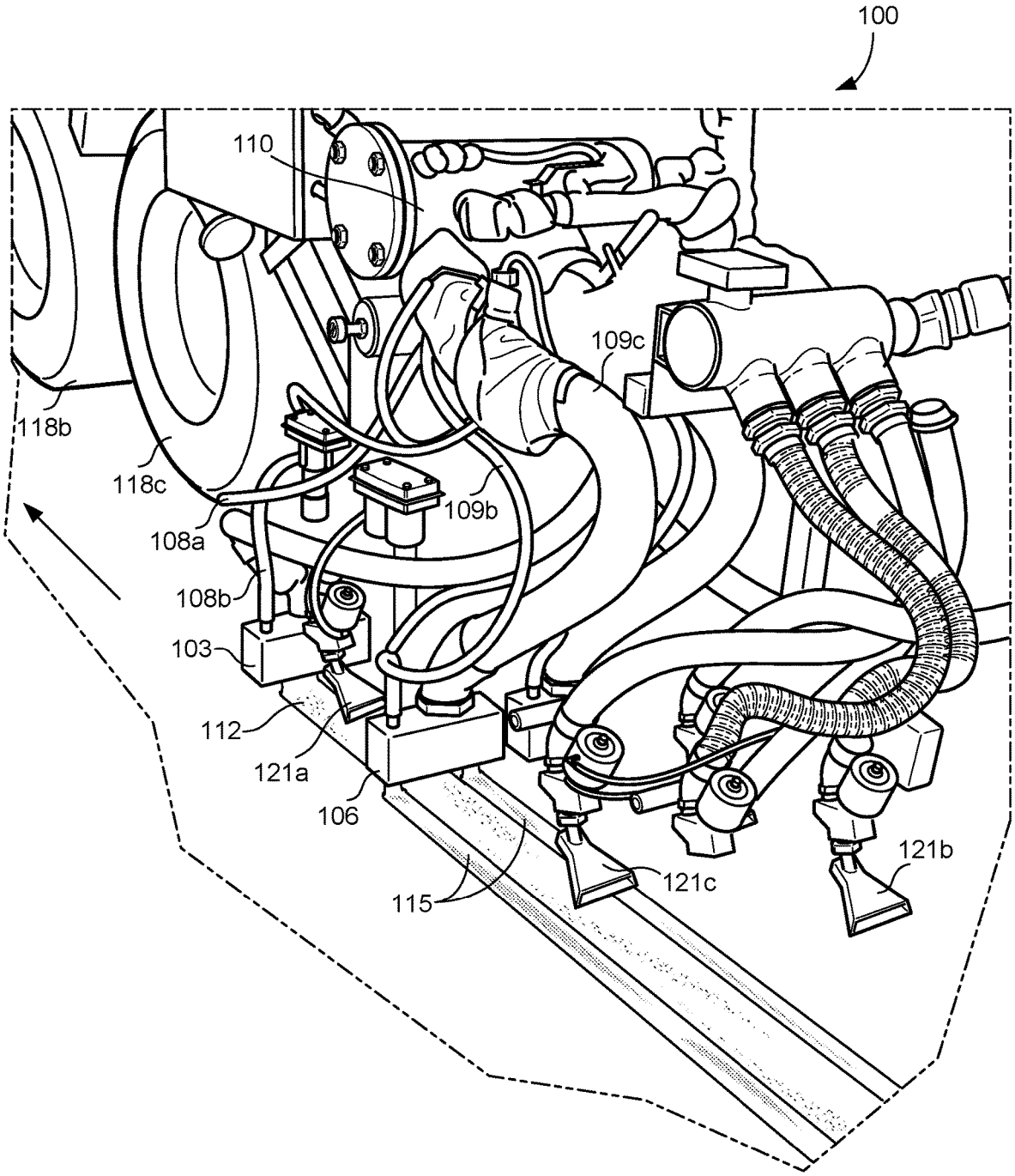
FIG. 2 is an illustration of a rear-side perspective view of the contrast road marking apparatus of FIG. 1 positioned alongside a roadway according to various embodiments of the present disclosure.

FIG. 2 is another illustration of the rear-side perspective view of the example contrast road marking apparatus 100 shown in FIG. 1. The ribbon guns 103 and 106 are connected to a manifold 110, which houses thermoplastic material to be applied by the ribbon guns. The apparatus 100 includes glass sphere applicators 121*a*, 121*b*, and 121*c* for sprinkling glass spheres, reflective elements, skid resistant particles, or a combination thereof on top of the contrast markings 112 or 115 before the markings 112 or 115 have completely solidified. However, some embodiments may not include the glass sphere applicators 121*a*, 121*b*, and 121*c*. The apparatus 100 also includes a plurality of wheels 118*b* and 118*c*, which may be wheels of an application vehicle or any other moving vehicle that can aid in moving the apparatus 100 along a roadway according to various embodiments.

In FIG. 2, the first ribbon gun 103 is configured to apply a first thermoplastic marking 112, and the second ribbon gun 106 is aligned behind the first ribbon gun 103 and configured to apply a second thermoplastic marking 115. According to various embodiments, the thicknesses (e.g., 816, 819*a*, 819*b*) of the markings 112 and 115 are equal or substantially equal and may range from about 0.040" to about 0.150". In addition, the widths (e.g., 812*a*, 812*b*) of the second thermoplastic marking 115 are equal or substantially equal. In some embodiments, there may be two ribbon guns aligned behind the first ribbon gun 103, so that each ribbon gun behind the first ribbon gun 103 can apply the second thermoplastic marking 115 on one side of the first thermoplastic marking 112.

Figure 3:
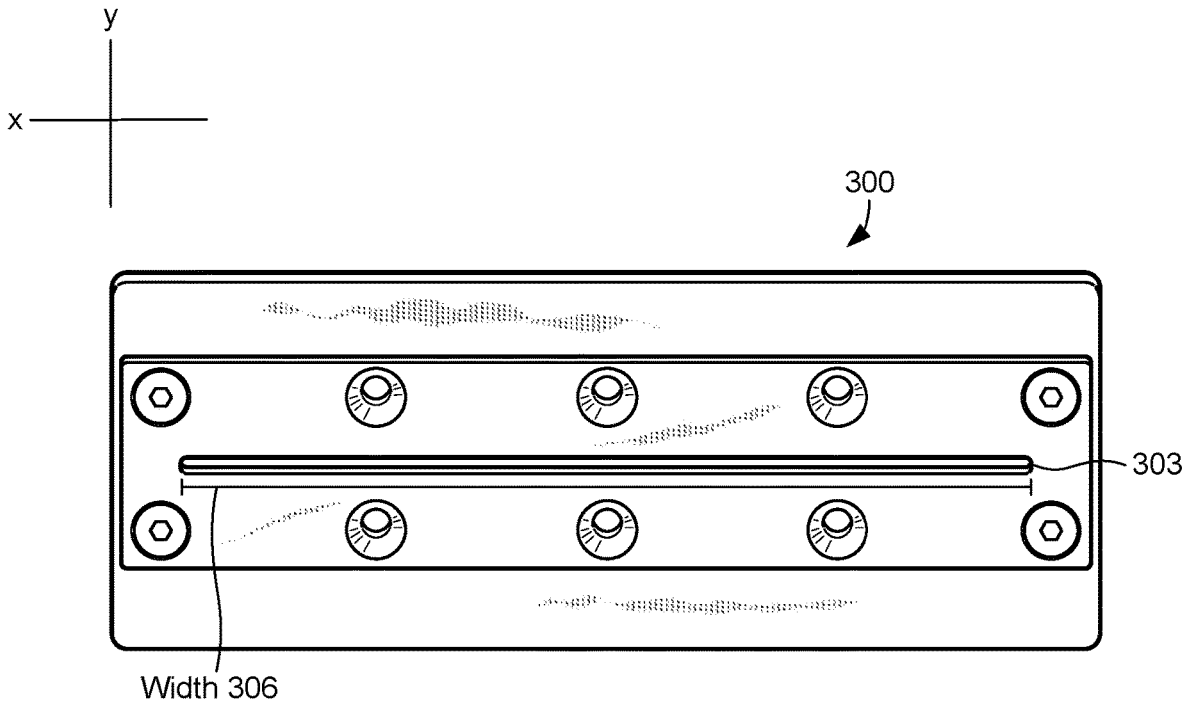
FIG. 3 is an illustration of a bottom view of a first ribbon gun of FIGS. 1 and 2 with an open slot according to various embodiments of the present disclosure.

FIG. 3 is an illustration of a bottom side 300 of the first ribbon gun 103 with a slot 303 in an open position. According to various embodiments, the width 306 of the slot can vary depending on the width (e.g., 804, 810) of the first thermoplastic marking 112 desired. When the slot 303 is in an open position, thermoplastic material can come out of this slot as shown in FIGS. 1 and 2. For example, if a 6" wide white marking is desired, a first ribbon gun 103 with a 6" wide slot 303 can be configured to apply the first thermoplastic marking 112 to a first roadway location.

Figure 4:
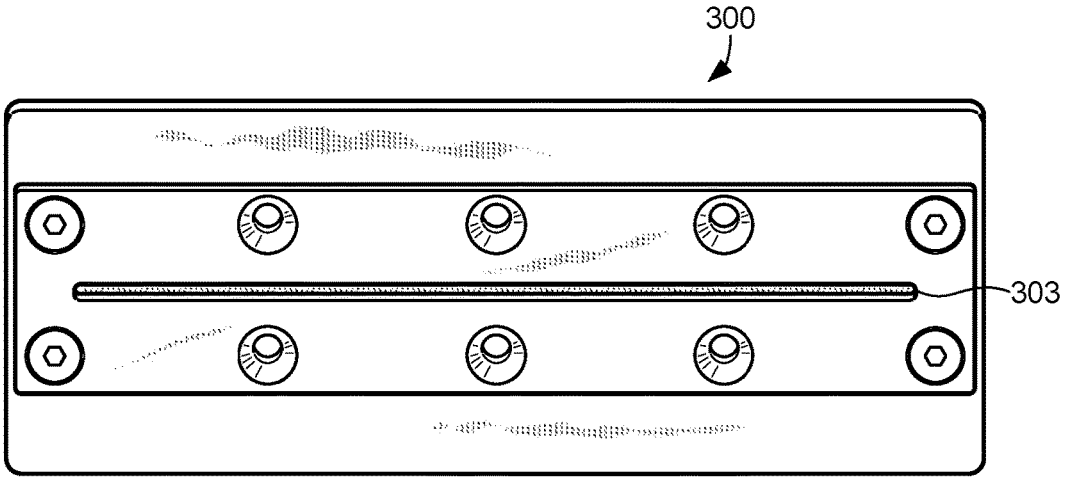
FIG. 4 is an illustration of a bottom view of a first ribbon gun of FIGS. 1 and 2 with a closed slot according to various embodiments of the present disclosure.

FIG. 4 is another illustration of a bottom side 300 of the first ribbon gun 103 but with the slot 303 in a closed position. When material flow is not desired, a knife blade can push into the slot, thus creating the closed position.

Figure 5:
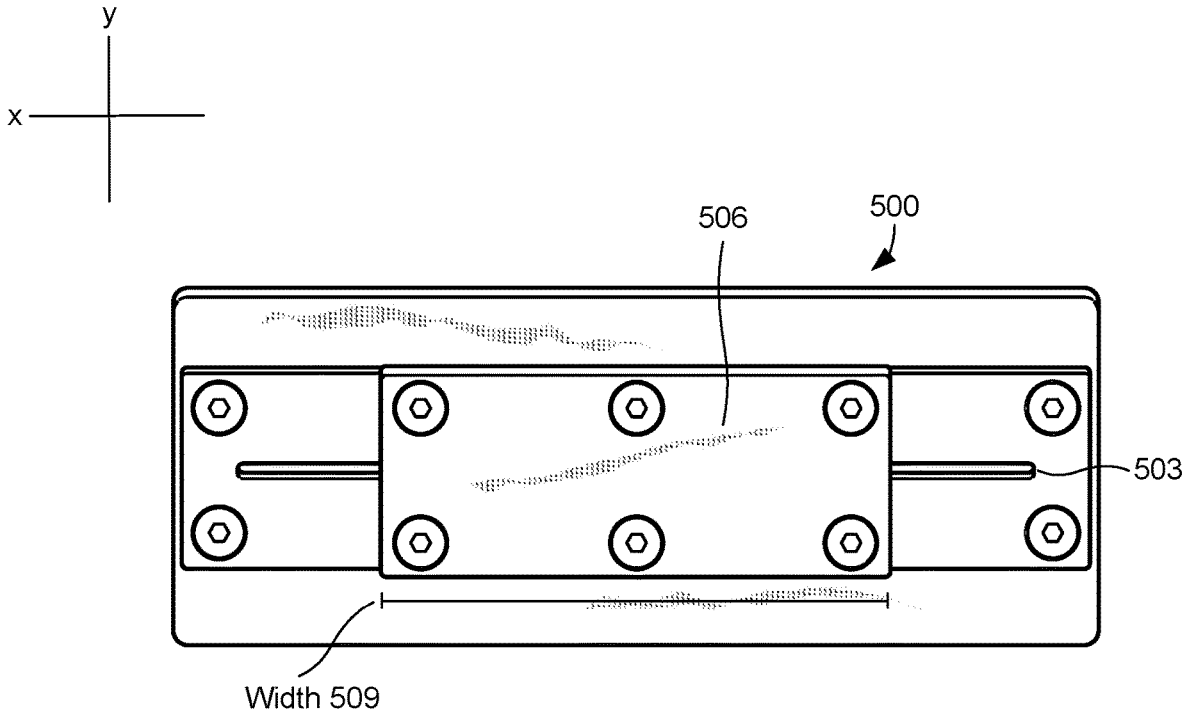
FIG. 5 is an illustration of a bottom view of a second ribbon gun of FIGS. 1 and 2 with an affixed blocking plate with an open slot according to various embodiments of the present disclosure.

FIG. 5 is an illustration of a bottom side 500 of the second ribbon gun 106 with a slot 503 in an open position according to various embodiments. The bottom side 500 also includes a blocking plate 506 affixed to its center portion. In this illustration, the blocking plate 506 is positioned to block thermoplastic material from flowing out of a predefined middle area of the slot 503. For example, if the slot 503 is 10" wide and the blocking plate 506 is 6" inches wide, thermoplastic material would only flow out of the outer two inches of the slot 503 on each side.

According to various embodiments, if a contrasting marking 115 is desired on both sides of the lighter marking as shown in FIGS. 1 and 2, a blocking plate 506 with a width 509 equal to the width (e.g., 804, 810) of the first thermoplastic marking 112 would be chosen. A blocking plate 506 with such a width 509 would ensure that the contrasting marking 115 does not get applied to where the first thermoplastic marking 112 has already been applied and prevent intermixing of the two markings, thus producing a satisfactory marking with substantially negligible overlap or gap between the two markings.

For example, if a 6" wide white thermoplastic marking with a 2" wide black contrast on both sides is desired, a first ribbon gun 103 with a 6" wide (e.g., 306) slot 303 can be configured to apply the first thermoplastic marking 112 to a first roadway location. Then, a second ribbon gun 106 can be positioned behind the first ribbon gun 103 at a predefined distance so that the center of the two ribbon guns are aligned. The second ribbon gun 106 would have a 10" wide (e.g., 512) slot 503 with a 6" wide (e.g., 509) blocking plate 506 that is affixed to the bottom 500 of the second ribbon gun 106. Then, the second ribbon gun 106 would be configured to start applying the second thermoplastic marking 115 to second and third roadway locations after a specified delay. Once the delay is reached, thermoplastic material would come out of only the outer two inches of the slot 503 on each side, thus allowing the two markings 112 and 115 to be applied in the same pass. The result would be a 6" wide white first thermoplastic marking 112 with 2" wide black second thermoplastic marking 115 on both sides of the first thermoplastic marking 112 without any visible or substantially negligible overlap or gap between them, as shown in FIGS. 1 and 2. When one thermoplastic marking is applied shortly before the other one, the first one can cool slightly and partially firm up with much higher viscosity, preventing the mixing of the two colors by setting a dam to contain the second thermoplastic marking while keeping the edges relatively smooth between them.

In some embodiments, if a 6" wide white thermoplastic marking with a 2" wide black contrast on both sides is desired, a first ribbon gun 103 with a 6" wide (e.g., 306) slot 303 can be configured to apply the first thermoplastic marking 112 to a first roadway location. In lieu of a blocking plate 506, the second ribbon gun 106 could be made to have two 2" wide slots that are 6" apart from each other to align the first ribbon gun 103 with the second ribbon 106. The second ribbon gun 106 would then be configured to apply the second thermoplastic marking 115 to second and third roadway locations as described in the preceding paragraph.

In alternative embodiments, multiple ribbon guns can be used to apply the second contrasting thermoplastic marking 115 on both sides of the first thermoplastic marking 112. For example, two ribbon guns without blocking plates, each with 2" wide slots and aligned horizontally with each other, can be positioned behind the first ribbon gun 103 to apply the second contrasting thermoplastic marking 115. However, a disadvantage to using multiple ribbon guns to apply the second thermoplastic marking 115 would be that the slot of one ribbon gun could open or close, faster or slower, than the other one, thus not guaranteeing a simultaneous application of the second contrasting thermoplastic marking 115.

Figure 6:
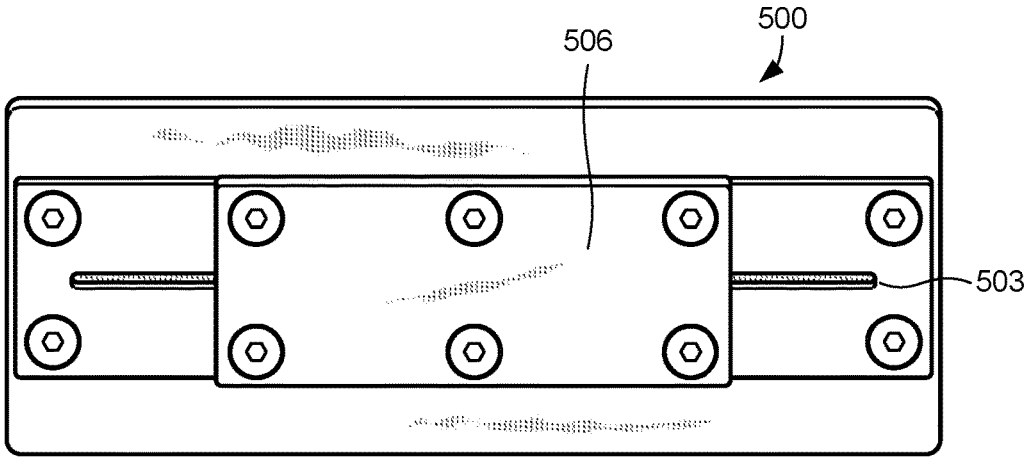
FIG. 6 is an illustration of a bottom view of a second ribbon gun of FIGS. 1 and 2 with an affixed blocking plate with a closed slot according to various embodiments of the present disclosure.

FIG. 6 is an illustration of a bottom side 500 of the second ribbon gun 106 with a slot 503 in a closed position. The bottom side 500 also includes a blocking plate 506 affixed to its center portion. When material flow is not desired, a knife blade can push into the slot, thus creating the closed position.

Figure 7:
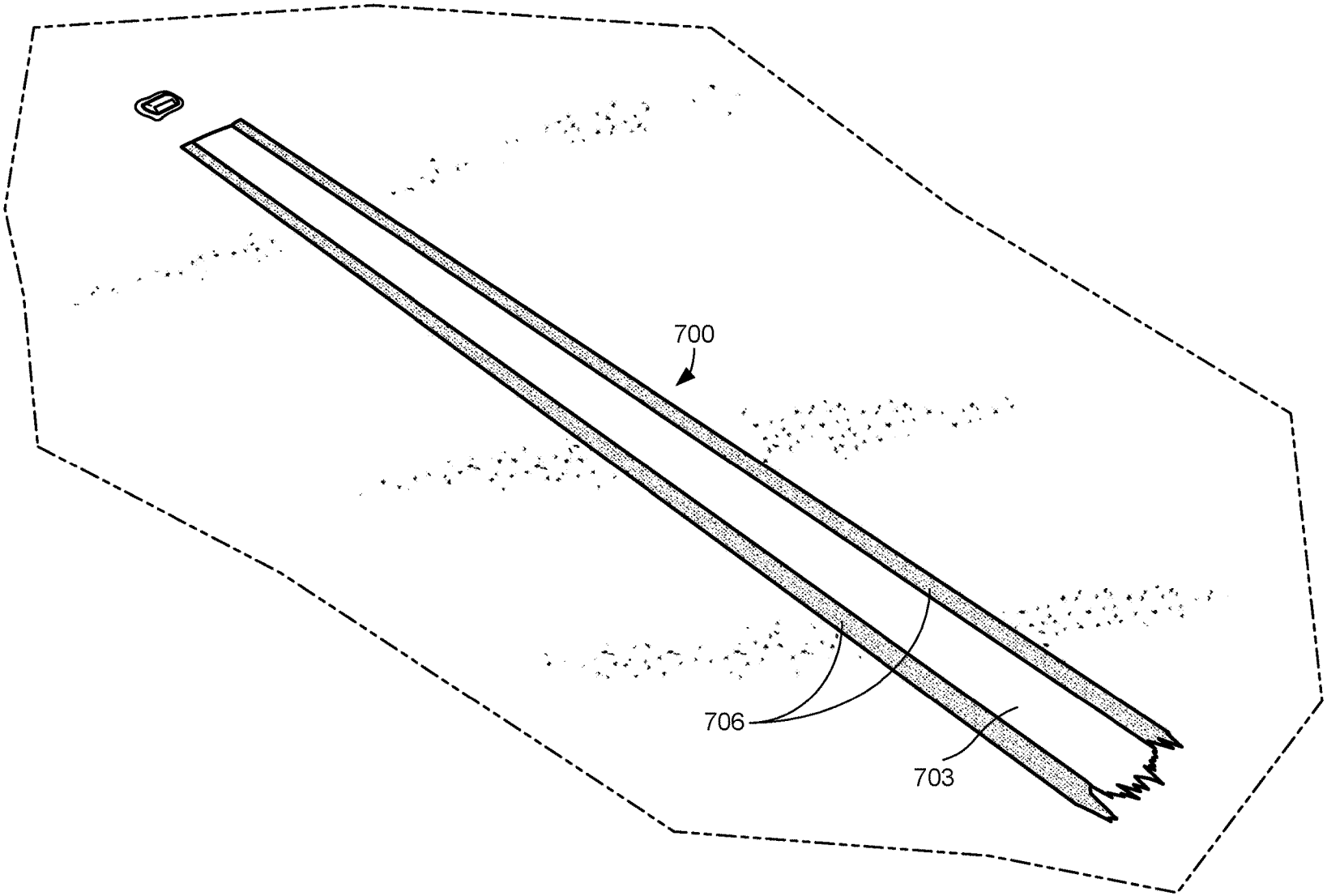
FIG. 7 is an illustration of an example contrast marking applied by the contrast road marking apparatus of FIGS. 1 and 2 according to various embodiments of the present disclosure.

FIG. 7 is an illustration of a contrast road marking 700 applied to a roadway according to various embodiments of the present disclosure. The contrast road marking 700 comprises a first thermoplastic marking 703 that is applied to a first roadway location. The contrast road marking 700 further comprises a second thermoplastic marking 706 applied to second and third roadway locations next to both sides of the first thermoplastic marking 703. The markings 703 and 706 have no visible or substantially negligible overlap or gap between the two markings.

Figure 8A:
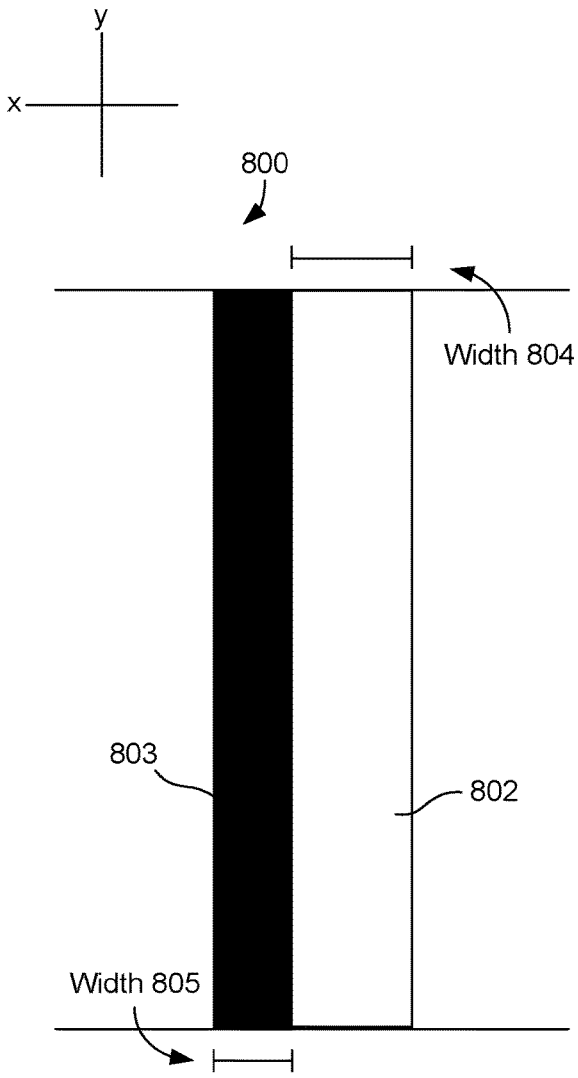
FIG. 8A is an illustration of a bird's eye perspective view of a possible contrast marking showing widths for each individual marking according to various embodiments of the present disclosure.

FIG. 8A is an illustration of a bird's eye perspective view of a contrast road marking 800 applied to a roadway according to various embodiments. In this illustration, the contrast road marking 800 includes a first thermoplastic marking 802 applied to a roadway location and a second thermoplastic marking 803 applied only on one side of the first thermoplastic marking 802 at a second roadway location. The color of the second thermoplastic marking 803 is black, which contrasts with the color of the first thermoplastic marking 802, which is white. However, any colors that give sufficient contrast may be chosen for the markings 802 and 803. Additionally, the second thermoplastic marking 803 may be applied on either side of the first thermoplastic marking 802. Each width 804 and 805 of the respective thermoplastic markings 802 and 803 is the distance measured from one end of the respective marking to the other end of the respective marking in the X direction as shown by the illustration.

The contrast road marking 800 can be applied by the contrast road marking apparatus 100 in a same pass as discussed above. The first ribbon gun 103 can be configured to apply the first thermoplastic marking 802, while the second ribbon can be configured to apply the second thermoplastic marking 803 beside the first thermoplastic marking 802. The second ribbon gun 106 will be configured to start applying the second thermoplastic marking 803 after a delay, wherein the delay will give the first thermoplastic marking 802 ample time to cool slightly and partially firm up before the second thermoplastic marking 803 is applied beside it. The positioning of the ribbon guns 103 and 106 and the delay allow the two markings 802 and 803 to be applied in a same pass without any visible or substantially negligible overlap or gap between them.

Figure 8B:
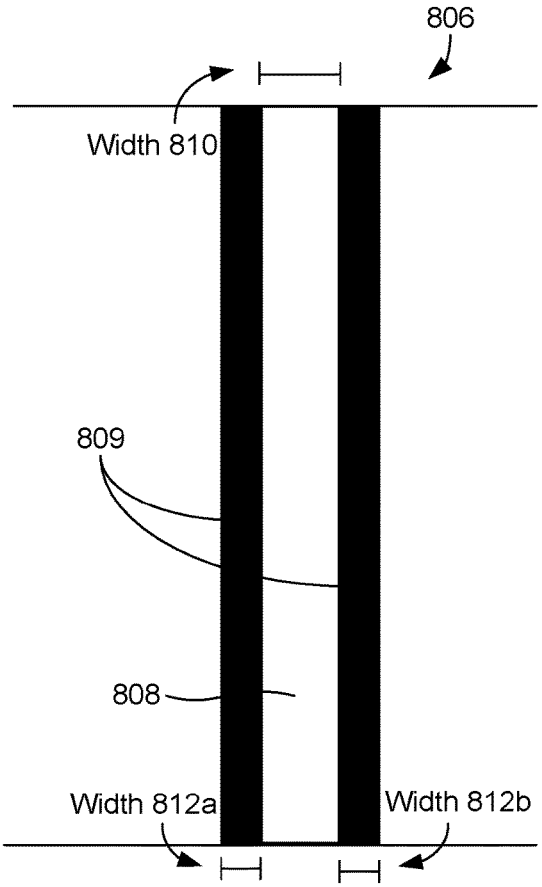
FIG. 8B is another illustration of a bird's eye perspective view of an example contrast road marking applicable by the contrast road marking apparatus of FIGS. 1 and 2 showing widths for each individual marking according to various embodiments of the present disclosure.

FIG. 8B is an illustration of a bird's eye perspective view of a contrast road marking 806 applied to a roadway according to various embodiments. In this illustration, the first thermoplastic marking 808 is surrounded on both sides by the second thermoplastic marking 809. The contrast road marking 806 is an example of what the thermoplastic markings 112 and 115 from FIGS. 1 and 2, and contrast road marking 700 from FIG. 7 would look like from a bird's eye perspective view. Each width 810, 812*a*, and 812*b* of the respective thermoplastic markings 808 and 809 is the distance measured from one end of the respective marking to the other end of the respective marking in the X direction as shown in the illustration. Additionally, widths 812*a* and 812*b* are equal or substantially equal.

Figure 8C:
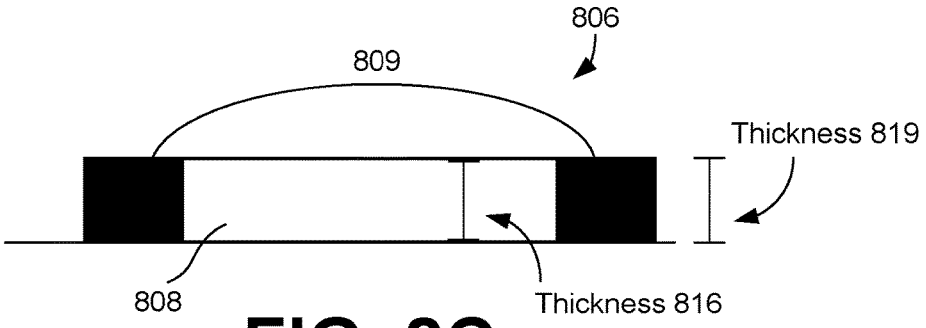
FIG. 8C is an illustration of a cross sectional view of the contrast road marking of FIG. 8B showing thicknesses for each individual marking.

FIG. 8C is an illustration of a cross sectional view of the contrast road marking 806. Thickness 816 of the first thermoplastic marking 808 is equal or substantially equal to the thicknesses 819*a* and 819*b* of the second thermoplastic marking 809. Thicknesses of each of the markings can range from about 0.040" to about 0.150".

Figure 9:
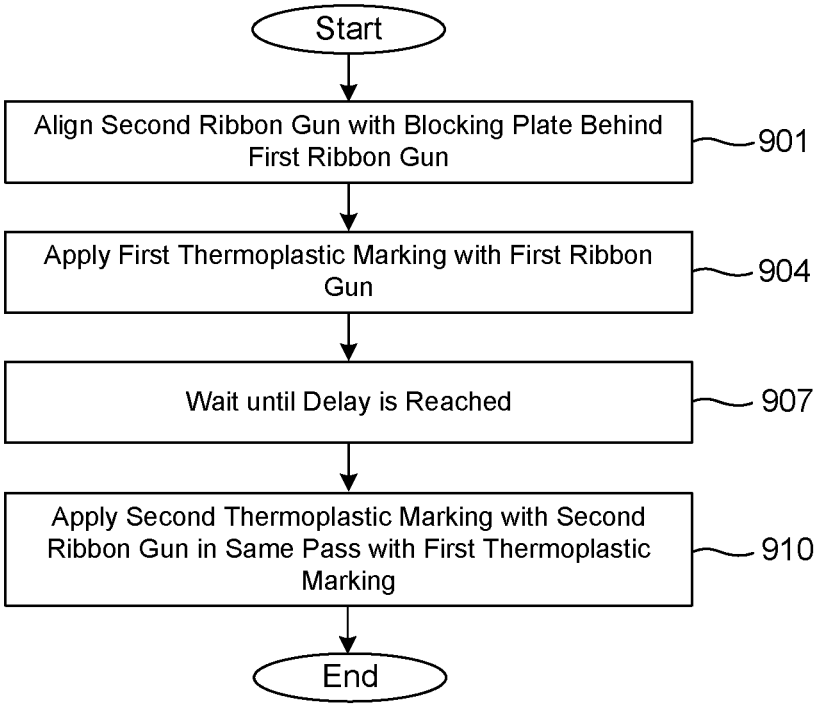
FIG. 9 is a flowchart of an example process of applying contrast road markings to a roadway by the contrast road marking apparatus of FIGS. 1 and 2 according to various embodiments of the present disclosure.

Turning next to FIG. 9, shown is a flowchart that provides one example of the operation of the contrast road marking apparatus 100 according to various embodiments. It is understood that the flowchart of FIG. 9 provides merely an example of the many different arrangements that can be employed to implement the operation of the contrast road marking apparatus 100 as described herein.

Beginning with step 901, the second ribbon gun 106 with a blocking plate 506 affixed to its bottom side 500 is positioned behind the first ribbon gun 103 at a predefined distance so that the centers of the two ribbon guns 103 and 106 are aligned. The predefined distance between the two ribbon guns 103 and 106 should be relatively short, wherein the delay in applying the second thermoplastic marking 115 with the second ribbon gun 106 allows the first thermoplastic marking 112 to partially cool and firm up. The ribbon guns 103 and 106 are attached to the apparatus 100 and are moved alongside the road through a plurality of wheels.

Next, in step 904, the first ribbon gun 103 is configured to apply the first thermoplastic marking 112 to a first roadway location. Thermoplastic material from the manifold 110 flows through oil jacketed feed lines 108*a* and 108*b* and out of the slot 303 of the bottom side 300 of the first ribbon gun 103. As the apparatus 100 is moved alongside the roadway by an application vehicle, the apparatus applies the first thermoplastic marking 112 to a first roadway location.

Next, in step 907, a delay timer is activated once the first ribbon 103 has started applying the first thermoplastic marking 112. This delay is a time or distance required for the second ribbon gun 106 to reach a same or substantially similar starting and stopping application position as the first ribbon gun 103 so that both ribbon guns can start and stop applying the thermoplastic markings 112 and 115 at substantially similar roadway locations while in a same pass.

Then, in step 910, the second ribbon gun 106 with a blocking plate 506 affixed to its bottom side 500 is configured to apply the second thermoplastic marking 115 to second and third roadway locations on both sides of the first thermoplastic marking 112 once an appropriate delay has been reached. Thermoplastic material from the manifold 110 flows through oil jacketed feed lines 109*b* and 109*c* and out of the slot 503 of the bottom side 500 of the second ribbon gun 106. The width 509 of the blocking plate 506 would equal the width (e.g., 804, 810) of the first thermoplastic marking 112 to ensure that the two markings 112 and 115 do not intermix. The second ribbon gun 106 applies the second thermoplastic marking at a substantially similar starting roadway location as the first ribbon gun 103 while on the same application vehicle and in the same pass. Once the second ribbon gun 106 reaches a similar stopping position as the first ribbon gun 103, the second ribbon gun 106 is configured to stop. The result is a contrast road marking without any visible or substantially negligible overlap or gap between the first and second thermoplastic markings.

Alternatively, the positions of the first and second ribbon guns 103, 106 can be swapped, wherein the second ribbon gun 106 is configured to apply the second thermoplastic marking 115 first and the first ribbon gun 103 is configured to apply the first thermoplastic marking 112 after a delay.

This delay is a time or distance required for the first ribbon gun 103 to reach a same or substantially similar starting and stopping application position as the second ribbon gun 106 so that both ribbon guns can start and stop applying the thermoplastic markings 112 and 115 at substantially similar roadway locations while in a same pass.

In some embodiments, two ribbon guns without blocking plates may be aligned behind the first ribbon gun 103 to apply the second thermoplastic marking 115 on second and third roadway locations on both sides of the first thermoplastic marking 112. Additionally, a second ribbon gun without a blocking plate may be aligned behind the first ribbon gun 103 but in a different position to apply the second thermoplastic marking (e.g., 803) at a second roadway location on only one side of the first thermoplastic marking (e.g., 802).

It should be emphasized that the above-described embodiments of the present disclosure are merely possible examples of implementations set forth for a clear understanding of the principles of the disclosure. Many variations and modifications can be made to the above-described embodiment(s) without departing substantially from the spirit and principles of the disclosure. All such modifications and variations are intended to be included herein within the scope of this disclosure and protected by the following claims.

Therefore, at least the following is claimed:

1. An apparatus for applying thermoplastic markings to a roadway, the apparatus comprising:

a first ribbon gun configured to apply a first thermoplastic marking;

a second ribbon gun configured to apply a second thermoplastic marking, the first thermoplastic marking having a first color that contrasts with a second color of the second thermoplastic marking;

means for orienting the first ribbon gun so that the first thermoplastic marking is applied onto the roadway at a first roadway surface area;

means for orienting the second ribbon gun so that the second thermoplastic marking is applied onto the roadway at a second roadway surface area, the second roadway surface area being adjacent to and substantially mutually exclusive of the first roadway surface area; and means for moving the apparatus along the roadway.

2. The apparatus of claim 1, wherein the first and second thermoplastic markings have equal or substantially equal thickness.

3. The apparatus of claim 1, wherein the first and second thermoplastic markings have no visible or substantially negligible overlap or gap between them.

4. The apparatus of claim 1, wherein the second ribbon gun is aligned behind the first ribbon gun at a predefined distance.

5. The apparatus of claim 1, wherein the first ribbon gun is configured to start applying the first thermoplastic marking first and the second ribbon gun is configured to start applying the second thermoplastic marking after a delay, the delay being a distance or time required for the second ribbon gun to reach a same or substantially similar starting position as the first ribbon gun.

6. The apparatus of claim 1, wherein the first and second ribbon guns are configured to apply the first and second thermoplastic markings in a same pass.

7. The apparatus of claim 1, further comprising a third ribbon gun aligned horizontally with the second ribbon gun, the third ribbon gun applying third thermoplastic marking at a third roadway surface area, the third roadway surface area being spaced the same horizontal distance from the first roadway surface area as the second roadway surface area but on a side of the first roadway surface area opposite the second roadway surface area.

8. An apparatus for moving along a roadway and applying thermoplastic markings to the roadway, the apparatus comprising:

a first ribbon gun configured to apply a first thermoplastic marking at a first roadway surface area; and a second ribbon gun configured to apply a second thermoplastic marking at a second roadway surface area, the second roadway surface area being different than and adjacent to the first roadway surface area;

wherein each of the first and second thermoplastic surface areas are elongated in the travel direction with right and left edges, the left edge of the first thermoplastic surface area being substantially contiguous with the right edge of the second thermoplastic marking, or alternatively, the right edge of the first thermoplastic surface area being substantially contiguous with the left edge of the second thermoplastic marking.

9. The apparatus of claim 8, wherein the first thermoplastic marking has a first color that contrasts with a second color of the second thermoplastic marking.

10. The apparatus of claim 8, wherein the first and second thermoplastic markings have equal or substantially equal thickness.

11. The apparatus of claim 8, wherein the first and second thermoplastic markings have no visible or substantially negligible overlap or gap between them.

12. The apparatus of claim 8, wherein the second ribbon gun is aligned behind the first ribbon gun at a predefined distance.

13. The apparatus of claim 8, wherein the first and second ribbon guns are configured to apply the first and second thermoplastic markings in a same pass.

14. The apparatus of claim 8, further comprising a third ribbon gun aligned horizontally with the second ribbon gun, the third ribbon gun applying a third thermoplastic marking at a third roadway surface area, the third roadway surface area being spaced the same horizontal distance from the first roadway surface area as the second roadway surface area but on a side of the first roadway surface area opposite the second roadway surface area.

15. The apparatus of claim 14, wherein the second and third thermoplastic marking are the same color.

* * * * *